US009631785B2

(12) United States Patent
Haenen et al.

(10) Patent No.: US 9,631,785 B2
(45) Date of Patent: Apr. 25, 2017

(54) LIGHTING UNIT AND VEHICLE HEADLAMP

(75) Inventors: Ludo Haenen, Sint Oedenrode (NL); Nils Benter, Dusseldorf (DE); Pascal Bloemen, Eindhoven (NL); Augustinus G. H. Meijers, Breda (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 118 days.

(21) Appl. No.: 13/119,270

(22) PCT Filed: Aug. 28, 2009

(86) PCT No.: PCT/IB2009/053765

§ 371 (c)(1),
(2), (4) Date: Mar. 16, 2011

(87) PCT Pub. No.: WO2010/032143

PCT Pub. Date: Mar. 25, 2010

(65) Prior Publication Data

US 2011/0170310 A1 Jul. 14, 2011

(30) Foreign Application Priority Data

Sep. 18, 2008 (EP) ..... 08105373

(51) Int. Cl.
*F21V 7/00* (2006.01)
*F21S 8/10* (2006.01)

(52) U.S. Cl.
CPC ..... *F21S 48/1159* (2013.01); *F21S 48/1195* (2013.01)

(58) Field of Classification Search
CPC ..... F21S 8/10; F21S 48/1159; F21S 48/1163; F21S 48/1317; F21S 48/1747; F21Y 2113/00; F21V 1/00
USPC ..... 362/235, 513
See application file for complete search history.

(56) References Cited

U.S. PATENT DOCUMENTS

| | | | | |
|---|---|---|---|---|
| 7,040,792 | B2 | 5/2006 | Brandenburg et al. | |
| 2002/0070681 | A1* | 6/2002 | Shimizu et al. | 315/246 |
| 2006/0072313 | A1* | 4/2006 | Magarill | 362/227 |
| 2007/0279924 | A1 | 12/2007 | Yagi | |
| 2008/0062712 | A1 | 3/2008 | Woodward | |

FOREIGN PATENT DOCUMENTS

| | | | |
|---|---|---|---|
| EP | 1371901 | A2 | 12/2003 |
| EP | 1447616 | A2 | 8/2004 |

* cited by examiner

*Primary Examiner* — Andrew Coughlin

(57) ABSTRACT

A lighting unit (1) is provided with a reflecting surface (2, 2', 2") for providing an output beam of light with at least two beam patterns. A first light source (5) and a second light source (7) are arranged to illuminate substantially identical surface areas of said reflecting surface (2, 2', 2") and are independently controllable from each other. The reflecting surface (2, 2', 2") is shaped and said light sources (5, 7) are positioned relative to said reflecting surface (2, 2', 2") so that said first light source (5) generates an output beam of light, having a first beam pattern and said at least second light source (7) generates an output beam of light, having a second beam pattern, different from said first beam pattern. A corresponding vehicle headlamp (10) comprises at least one lighting unit (1).

23 Claims, 3 Drawing Sheets

LIGHTING UNIT AND VEHICLE HEADLAMP

FIELD OF THE INVENTION

The invention relates to a lighting unit and a vehicle headlamp comprising at least a corresponding lighting unit.

BACKGROUND OF THE INVENTION

Lighting units for providing multiple lighting functions with at least a reflector and multiple lamps are known in the art and are commonly employed in recent automobile headlamps. For example, in a known vehicle headlamp, a halogen lamp is used, comprising two filaments for providing high and low beam functions with correspondingly arranged reflectors for beam shaping of the output beam to the desired beam pattern.

Due to new regulations and a strong demand to increase safety in the automobile industry, an increasing number of lighting functions with different beam patterns, e.g. high beam, low beam, fog light, parking light or daytime running light need to be provided, resulting in an increased number of lighting units for providing these lighting functions.

Since each lighting unit has to be accommodated in a suitable cavity and corresponding space in the front or rear section of a motor vehicle is limited—especially because of increasing safety and design demands—it is difficult to realize the increasing number of different lighting functions in modern motor vehicles.

SUMMARY OF THE INVENTION

It is therefore an object to provide a lighting unit and a corresponding vehicle headlamp, by means of which mutually distinct lighting functions can be realized, while maintaining compact dimensions.

The object is solved by a lighting unit according to claim 1 and vehicle headlamp according to claim 14. Dependent claims relate to preferred embodiments of the invention.

According to the invention, the lighting unit comprises a reflecting surface for providing an output beam of light and at least two light sources. A first light source is arranged to illuminate a first surface area of the reflecting surface. A second light source is arranged to illuminate a second surface area of the reflecting surface, which second surface area is substantially identical to said first surface area.

To provide an output beam having multiple beam patterns, the reflecting surface is shaped and said light sources are positioned relative to said reflecting surface, so that said first light source generates an output beam of light, having a first beam pattern and said at least second light source generates an output beam of light, having a second beam pattern, which is different from said first beam pattern. Further, the light sources are independently controllable from each other.

The lighting unit according to the invention allows providing an output beam of light with at least two distinguishable beam patterns, thus providing two lighting functions. Advantageously, substantially the same surface area of the reflecting surface is used for shaping the two beam patterns, thus reducing the overall size of the lighting unit, contrary to lighting units comprising dedicated and separate reflectors for each function.

In the context of the present invention, the term "substantially" with reference to the identity of the first and second surface areas is understood to comprise deviations of +−10%, i.e. the surface area of the reflecting surface illuminated by said first light source may deviate by +10% to −10% from the surface area illuminated by said second light source and vice versa.

As mentioned before, the light sources are independently controllable, i.e. it is possible to generate said first and second beam patterns independently from each other, so that an output beam having said first beam pattern or having said second beam pattern may be generated alternatively. Certainly it is possible to shape the reflector, so that a third beam pattern is generated, when said first and second light sources are switched on simultaneously, e.g. with one of the light sources in a dimmed state. To assure that the light sources are independently controllable, a suitable wiring may be used to connect the light sources to a power supply. For example, the light sources may be connected independently to at least a suitable switching controller, e.g. having transistor units, a relay or microcontroller devices, which controls the on/off state and may be furthermore adapted to dim the respective light source.

The reflecting surface may be of any suitable kind for forming the output beam, i.e. reflecting the incoming light of said first and second light source at least partly in the emitted wavelength range. The reflecting surface thus may be any kind of dielectric boundary surface at least for a part of the light, emitted by said first and second light sources. For example, the reflecting surface may be formed using a mirror, a suitable metallic material, metalized synthetic material or other specular (not diffuse) reflecting layer, such as a dichroic layer or multilayer arrangements.

The reflecting surface may have any suitable geometry for providing the first and the second beam pattern from light emitted by the light sources, positioned relative to the reflecting surface.

The overall set-up of the lighting unit and especially the shape of the reflecting surface and the positions of the light sources can be designed using a suitable optical design program. Several optical design programs for designing a corresponding reflecting surface are commercially available.

For example, the reflecting surface may be designed to provide the first beam pattern from said first light source, placed in a defined relation to the reflecting surface. Then the second LED light source is positioned relative to the reflecting surface according to the desired second beam pattern. Naturally, because of the fact that a substantially identical surface area of the reflecting surface is used for generating the first and second beam pattern, a certain degree of dependence between the two beam patterns exists, although it is nevertheless advantageously possible to generate mutually distinct beam patterns.

The reflecting surface may be for example of concave shape, but may also be designed more complex. Preferably, the reflecting surface is a freeform or complex-shape reflector. Such a complex-shape reflector may e.g. be designed using ray-tracing methods or suitable optical design rules, known in the art.

The light sources may be of any suitable type, e.g. incandescent, halogen or gas discharge type. Preferably, the light sources are LED light sources.

The LED light sources each comprise at least one light emitting diode (LED), which allows an even more compact design and a very energy-efficient operation of the lighting unit. The luminous flux of said LEDs may be chosen in dependence of the application. The LEDs may preferably provide a luminous flux of at least 25 lm. In some applications, a total luminous flux of at least 100 lm per light source may be advantageous. It is therefore preferred that high power LEDs are used, i. e. LEDs with a luminous flux of greater than 100 lm per LED and preferably equal to or greater than 125 lm, depending on the desired luminous flux of the output beam and the overall efficacy of the lighting unit. Alternatively or additionally to a setup having high-power LEDs, said first and/or said second LED light source may preferably comprise multiple LEDs. Such a set-up advantageously allows providing a given luminous flux using multiple LEDs having a lower flux, thus may be very cost-efficient.

For example, multiple single LEDs, positioned as close as possible, a multi-dye LED with or without an additional encapsulation, e.g. a "dome", may be used.

Additionally to the enhancement of the luminous flux, the beam shape of said first and second beam pattern may be influenced by providing multiple LEDs. For example when providing an LED light source having an LED-array, the effective source size of the LED light source becomes large, which allows to further adapt the emitted light to the desired beam pattern.

According to a preferred embodiment, said first light source is arranged in the focal center of said reflecting surface, which allows an especially cost-effective design of the lighting unit. Certainly, a slight deviation of the position of the first light source from the focal center in a range of 5 mm is possible and is construed to be within the scope of the present embodiment. Preferably, said reflecting surface is symmetrical and said first light source is arranged in the plane of symmetry of said reflecting surface. The present setup advantageously enables a further simplified design of the reflecting surface, especially in case said first beam pattern is substantially symmetrical.

According to a preferred embodiment, said second light source comprises at least two light emitting diodes, separated from each other by said first light source. This setup allows a very efficient generation of the two beam pattern, while maintaining especially compact dimensions.

The first and second beam pattern may have any suitable lighting distribution, according to the desired lighting function. For example and with reference to motor vehicle lighting functions, such lighting functions may include low beam, high beam, fog light, parking light, brake light or daytime running light.

According to a preferred embodiment, the reflecting surface is shaped so that said first beam pattern has a substantially horizontal bright/dark cut-off and said second beam pattern has no horizontal bright/dark cut-off In the context of the present invention, the term "cut-off" refers to an abrupt change in the intensity of the emitted beam and usually refers to a line, separating a solid angle range having low light levels from a solid angle range having higher light levels used for the application, e.g. fog light. According to the present embodiment, the term "substantially horizontal" is understood to comprise slight angular deviations of +−2°. Certainly, said second beam pattern does not necessarily have to exhibit a completely constant luminous flux in a vertical direction, but shall not show a sharp horizontal cut-off The set-up according to the present embodiment advantageously allows combining two fundamental different beam patterns, such as for example fog light and daytime running light, which is especially preferred.

Roughly described, a fog light beam pattern exhibits a horizontal cut-off at an angle of approximately −1 ° vertically from the optical axis, so that the oncoming traffic is not dazzled, i.e. the light is directed downwards. The daytime running light beam pattern usually exhibits a symmetrical radiation pattern in a solid angle range of at least −10° to +10° vertically and −20° to +20° horizontally, thus does not show a cut-off. Details of the beam characteristics of the fog light beam pattern may be for example found in ECE regulation NFF type F3, NFF type B or SAE regulation J583 (normal and harmonized). A specification of a daytime running light beam pattern may be found in ECE regulation R87 and SAE regulation J2087.

According to a preferred embodiment of the invention, the first and second light source are arranged, so that the reflecting surface is entirely illuminable by each of said first and second light source. A set-up according to the preferred embodiment provides an even more compact design of the lighting unit. In case one or both of the first and second light source comprises multiple LEDs, it is especially preferred, that the reflecting surface is entirely illuminable by each of said LEDs.

It is further preferred, that said first and second light source are arranged on a common printed circuit board (PCB). The arrangement on common PCB entails the advantage to easily connect the light sources using the PCB, for example to a power supply unit. The PCB further fulfills the function of a support for the lighting units. The PCB may be connected with the reflecting surface or any other component of the light source, for example a housing. Certainly, the PCB may comprise further components, such as the before mentioned switching controller, adapted to control the light sources independently.

According to a preferred embodiment of the invention, the first and/or second light source comprises an optical element arranged on an optical path between said first and/or second light source and the reflecting surface. Using the optical element, it is advantageously possible to further adapt the beam of light, provided by the respective light source to the desired beam pattern. The optical element may be of any suitable kind, such as a diffusion element, a lens element or an aperture. It is preferred that the optical element is arranged between the respective light source and the reflecting surface, so that only the beam of light, irradiated from the respective light source is affected by the optical element.

According to a development of the invention, the total surface area of the reflecting surface is in a range of 4 $cm^2$-225 $cm^2$, preferably 20 $cm^2$-225 $cm^2$ and most preferably 25 $cm^2$-200 $cm^2$.

A vehicle headlamp according to the invention comprises at least a lighting unit as described in the foregoing. The headlamp may comprise further elements, such as a housing or suitable wiring for providing electrical power to the lighting units. Furthermore, the headlamp may comprise a suitable and at least partly transparent cover, which may be formed as a lens for further beam shaping of the output beam according to the desired application.

According to a development, the vehicle headlamp comprises two lighting units as described before. The setup according to the present embodiment allows to further enhance the output beam of the vehicle headlamp or to provide multiple beam patterns, which may be provided by a combination of suitable beams of the single lighting units. For example, it is possible to adapt the reflecting surface of the first of the two lighting units to provide a light distribution that it widespread along a horizontal axis, while the reflecting surface of the second of said two lighting units is adapted to a point distribution in the center of the beam, provided by said first lighting unit. It is thus possible to provide an overall output beam, which provides a high luminous flux in the center of the beam and a correspondingly reduced luminous flux in areas, spaced from the optical axis, which may be desirable in motor vehicle applications. Certainly, it is possible to combine more than two lighting units in a vehicle headlamp.

Although the present invention has been described exemplary in the foregoing referring to a lighting unit for providing two distinct beam patterns, it is possible without any restriction, to modify the set-up for providing more than two beam patterns by a suitable design of the reflecting surface and corresponding arrangement of a number of light sources.

BRIEF DESCRIPTION OF THE DRAWINGS

The above and other objects, features and advantages of the present invention will become apparent from the following description of preferred embodiments, in which.

DETAILED DESCRIPTION OF EMBODIMENTS

Figure 1:
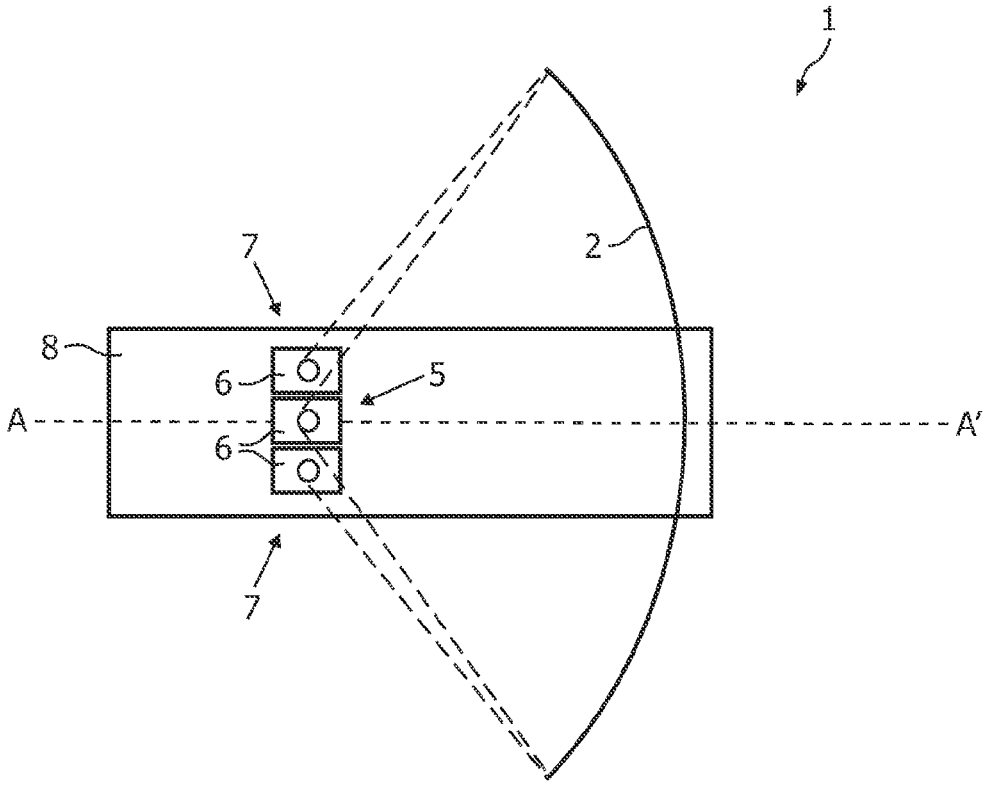
FIG. 1 shows a first embodiment of a lighting unit in a longitudinal sectional view along the optical axis.

FIG. 1 shows a first embodiment of a lighting unit 1 in a schematic and sectional view along the optical axis, denoted by the line A'-A. The lighting unit 1 comprises a reflector having a reflecting surface 2, which faces a first light source 5 and a second light source 7, which are of LED type according to the present embodiment. The reflector is made of plastic material and its surface 2 is metalized by vapor deposition to reflect light in the visible wavelength range. The reflecting surface 2 has a reflectivity of at least 75%, preferably at least 85%.

The reflecting surface 2 has a focal center on its optical axis A'-A and is designed to provide an output beam of light with a first beam pattern, having a substantially horizontal bright/dark cut-off According to the present example, the first beam pattern corresponds to a lighting distribution of a fog light, having horizontal cut-off at an angle of approximately −1° vertically from the optical axis.

The first light source 5 arranged in said focal center comprises a light emitting diode (LED) 6, which illuminates the reflecting surface 2 to provide said first beam pattern.

The second light source 7 comprises two LEDs 6, arranged adjacent to the first light source 5 in a direction perpendicular to the optical axis of the reflecting surface 2. The LEDs 6 are arranged "off-focus" to provide an output beam of light with a second beam pattern, which does not show said horizontal cut-off According to the present example, the second beam pattern corresponds to a lighting distribution of a daytime running light.

Both said first and second beam patterns are thus generated by a suitable design of the reflecting surface 2 and a corresponding positioning of the LEDs 6 of the respective light sources 5,7 relative to said reflecting surface 2.

The LEDs 6 are of high power type, providing white light with a luminous flux of 130 lm each and are mounted on a common printed circuit board 8, which provides the necessary electrical connections to a power supply unit (not shown) and which is mounted to the lower side of the reflecting surface 2 (also not shown in FIG. 1 for clarity reasons). The light sources 5, 7 are independently controllable from each other to be able to switch between the two beam patterns or to provide both beam patterns simultaneously, if necessary.

As can be seen from the dotted lines shown in FIG. 1, the LEDs 6 are arranged, so that the surface area of the reflecting surface 2 illuminated by the first light source 5 is substantially identical to the surface area illuminated by the second light source 7, i.e. according to the present example each of said LEDs 6 illuminate the entire surface area of the reflecting surface 2. Because both light sources 5, 7, providing the first and second beam pattern utilize substantially the same surface area of the reflecting surface 2, the lighting unit 1 exhibits very compact dimensions and can be easily integrated with a suitable cavity of a motor vehicle.

Figure 2:
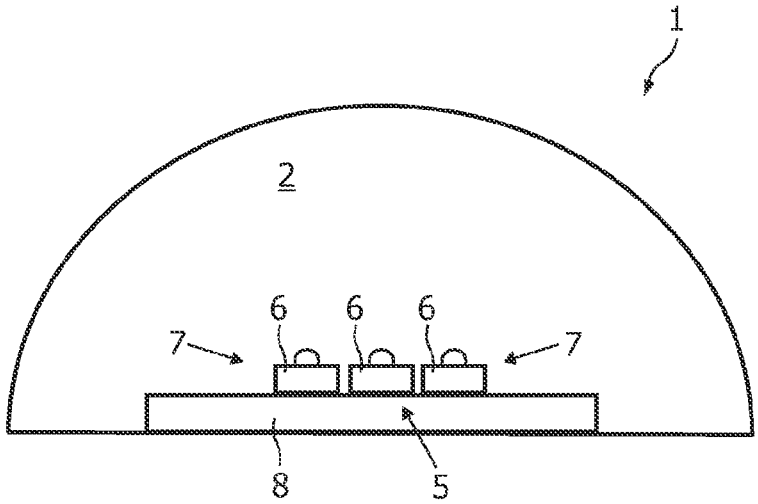
FIG. 2 shows a schematic front view of the embodiment of FIG. 1.

As can be seen from the front view of FIG. 2, the reflecting surface 2 is of half-dome shape for providing the before mentioned beam patterns. Design methods for creating a corresponding complex-shape reflecting surface 2 are known in the art. The reflecting surface 2 according to the present example has a surface area of 25 $cm^2$, so that the lighting unit 1 is very compact.

Figure 3A:
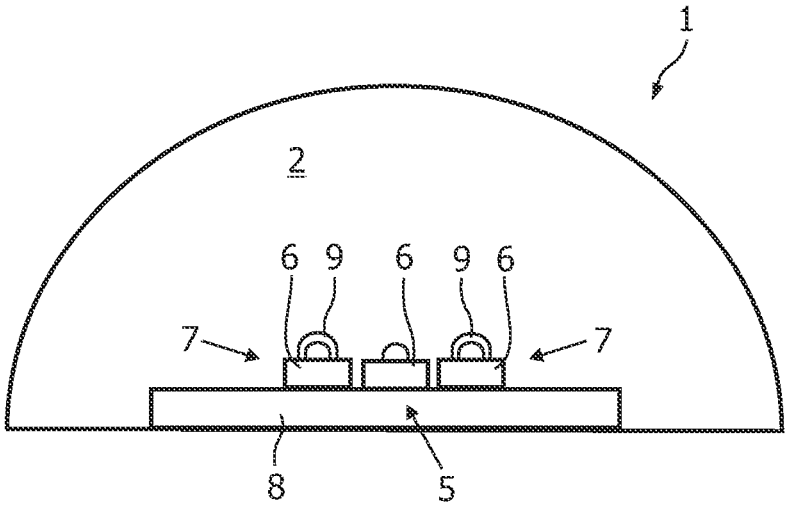
FIG. 3*a* shows a second embodiment of a lighting unit in a schematic front view.

FIG. 3*a* shows a second embodiment of a lighting unit 1 in a schematic front view. The present embodiment corresponds to the embodiment, shown in FIG. 2, with the exception that the LEDs 6 of the light source 7 are provided with hemispherical diffusion elements 9, so that the beam of light, generated by the second light source 7 is passed through the diffusion elements 9 before it is reflected by the reflecting surface 2. The diffusion elements 9 are made of transparent plastics with a correspondingly designed inner surface for diffusing the emitted light. Using said diffusion elements 9, the effective source size of the respective LEDs 6 is advantageously enlarged.

Figure 3B:
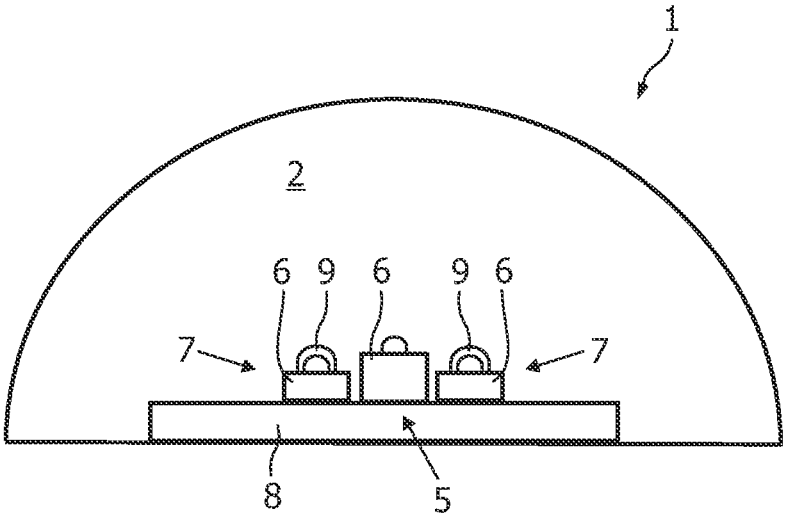
FIG. 3*b* shows a third embodiment of a lighting unit in a schematic front view and FIG. 4 shows an embodiment of a vehicle headlamp in a schematic front view.

FIG. 3*b* shows a further embodiment of a lighting unit 1. The embodiment according to the present figure corresponds to the embodiment of FIG. 3*a*, with the exception that the first lighting unit 5 is elevated against the LEDs 6 of the second lighting unit 7, providing an optimized positioning.

Figure 4:
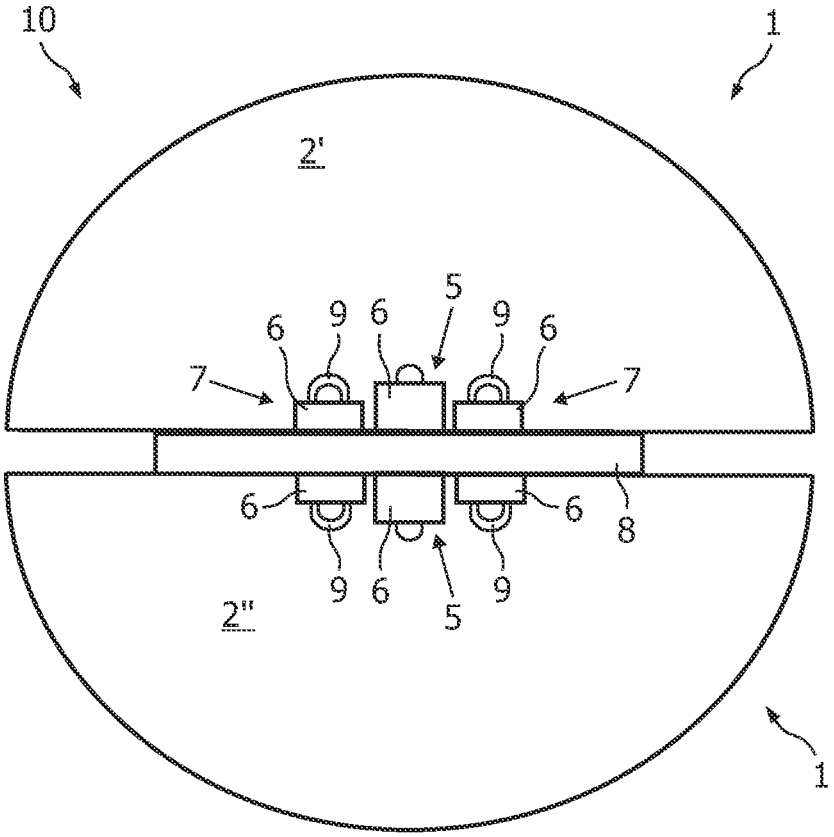

An embodiment of a vehicle headlamp 10 is shown in FIG. 4 in a schematic front view. The vehicle headlamp 10 comprises two lighting units 1 according to the embodiment of FIG. 3*b*, with the exception that a first reflecting surface 2' and a second reflecting surface 2" are designed to provide mutually distinct beam pattern. Such a set-up allows a further improved beam shaping, especially for providing fog light and daytime running light functions. The first reflecting surface 2' is shaped to provide a point light distribution, providing a high luminous intensity in a solid angle range near the optical axis. This is useful because both, fog light and daytime running light may require significant higher luminous intensities in this angle range compared to peripheral angular regions of the overall beam. The first reflecting surface 2' further provides the required horizontal cut-off for the fog light beam pattern, when the first light source 5 is switched on. The second reflecting surface 2" provides a widespread light distribution for the peripheral angular regions of the output beam. According to the present embodiment, all LEDs 6 are mounted on a common PCB 8, i.e. on an upper and lower side of the common circuit board 8. Although not shown, the vehicle headlamp 10 comprises a housing with a transparent front cover.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the reflecting surface 2, 2', 2" is adapted to provide further lighting beam patterns, such as high beam, low beam, parking light or a brake light, wherein none or both of the beam patterns exhibits a bright/dark cut-off, the reflecting surface 2, 2', 2" has a concave shape, instead of the diffusion elements 9, a lens or an aperture is used and/or the LEDs 6 are multi-dye LEDs or preferably LED-arrays.

Other variations to the disclosed embodiments can be understood and effected by those skilled in the art in practicing the claimed invention from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lighting unit, comprising:

a reflecting surface for providing an output beam of light, said reflecting surface comprising a freeform or complex-shape reflector, a first light source arranged to illuminate a first surface area of said reflecting surface and at least a second light source arranged to illuminate a second surface area of said reflecting surface, wherein:

said second surface area is substantially identical to said first surface area, said first and second light sources are positioned in a direction perpendicular to an optical axis of said reflecting surface, said reflecting surface is shaped and said light sources are positioned relative to said reflecting surface so that said first light source generates an output beam of light having a first beam pattern with a substantially horizontal bright/dark cut-off, and said at least second light source generates an output beam of light having a second beam pattern different from said first beam pattern and has no horizontal bright/dark cut-off, and said first light source and said second light source are independently controllable from each other to be able to provide the first beam pattern independent of the second beam pattern, to provide the second beam pattern independent of the first beam pattern, and to provide both first and second beam patterns simultaneously.

2. A lighting unit according to claim 1, wherein said light sources are LED light sources.

3. A lighting unit according to claim 1, wherein the reflecting surface has a concave shape.

4. A lighting unit according to claim 1, wherein said first and/or said second light source comprises multiple light emitting diodes.

5. A lighting unit according to claim 1, wherein said first light source is arranged in a focal center of said reflecting surfaces.

6. A lighting unit according to claim 1, wherein said reflecting surface is symmetrical and said first light source is arranged in the plane of symmetry of said reflecting surface.

7. A lighting unit according to claim 1, wherein said second light source comprises at least two light emitting diodes, separated from each other by said first light source.

8. A lighting unit according to claim 1, wherein said first beam pattern corresponds to a fog light beam pattern and said second beam pattern corresponds to a daytime running light beam pattern.

9. A lighting unit according to claim 1, wherein the first and second light sources are arranged so that the reflecting surface is entirely illuminable by each of said first and second light source.

10. A lighting unit according to claim 1, wherein said first and second light sources are arranged on a common printed circuit board.

11. A lighting unit according to claim 10, wherein said first light source is elevated on said printed circuit board relative to said second light source.

12. A lighting unit according to claim 10, further comprising a switching controller on said printed circuit board, said switching controller being adapted to independently control said first and second light sources.

13. A lighting unit according to claim 1, wherein the first and/or second light source comprises an optical element, arranged on an optical path between said light source and the reflecting surface.

14. A lighting unit according to claim 13, wherein said optical element comprises a diffusion element on said second light source.

15. A lighting unit according to claim 1, wherein the total surface area of the reflecting surface is in a range of 20 $cm^2$-225 $cm^2$.

16. A vehicle headlamp comprising at least a lighting unit according to claim 1.

17. A vehicle headlamp according to claim 16, comprising two lighting units.

18. A lighting unit, comprising:

a reflecting surface for providing an output beam of light, said reflecting surface comprising a freeform or complex-shape reflector;

a first light source arranged to illuminate a first surface area of said reflecting surface; and at least a second light source controllable independently of said first light source, said second light source being arranged to illuminate a second surface area of said reflecting surface, said second surface area being substantially identical to said first surface area;

wherein:

said first and second light sources are positioned in a direction perpendicular to an optical axis of said reflecting surface;

said reflecting surface is shaped and said light sources are positioned relative to said reflecting surface so that said first light sources generates an output beam of light having a first beam pattern with a substantially horizontal bright/dark cut-off, and said at least second light sources generates an output beam of light having a second beam pattern different from said first beam pattern and has no horizontal bright/dark cut-off;

said first light source is switched on and said second light source is switched off to generate said first beam pattern independent of said second beam pattern;

said second light source is switched on and said first light source is switched off to generate said second beam pattern independent of said first beam pattern; and said first light source is switched on and said second light source is switched on to generate said first beam pattern and said second beam pattern simultaneously.

19. A lighting unit according to claim 18, wherein one of said first light source and said second light source is in a dimmed state relative to the other of said first light source and said second light source when said first light source is switched on and said second light source is switched on to generate said first beam pattern and said second beam pattern simultaneously.

20. A lighting unit according to claim 18, wherein said first beam pattern corresponds to a fog light beam pattern and said second beam pattern corresponds to a daytime running light beam pattern.

21. A lighting unit according to claim 18, wherein said first and second light sources are arranged on a common printed circuit board.

22. A lighting unit according to claim 21, wherein said first light source is elevated on said printed circuit board relative to said second light source.

23. A lighting unit according to claim 21, further comprising a switching controller on said printed circuit board, said switching controller being adapted to independently control said first and second light sources.

* * * * *